United States Patent [19]

Takeno et al.

[11] Patent Number: 4,944,243

[45] Date of Patent: Jul. 31, 1990

[54] APPARATUS FOR AUTOMATICALLY PAINTING EXTERNAL WALL OF BUILDING

[75] Inventors: Masahiro Takeno, Hasuada; Yoshihito Sakai, Sagamihara; Atsushi Shirato, Kawaguchi, all of Japan

[73] Assignee: Taise Corporation, Tokyo, Japan

[21] Appl. No.: 369,187

[22] Filed: Jun. 21, 1989

[51] Int. Cl.[5] ..... B05C 1/02; B05C 5/00

[52] U.S. Cl. ..... 118/305

[58] Field of Search ..... 118/305

[56] References Cited

U.S. PATENT DOCUMENTS

| | | | |
|---|---|---|---|
| 1,440,147 | 12/1922 | Heinrich | 118/305 |
| 3,863,393 | 2/1975 | Goff | 118/305 |
| 4,417,542 | 11/1983 | Bellafiore | 118/305 |
| 4,677,936 | 7/1987 | Dahlem | 118/305 |

FOREIGN PATENT DOCUMENTS

| | | |
|---|---|---|
| 50-102640 | 8/1975 | Japan . |
| 51-97643 | 8/1976 | Japan . |
| 52-153768 | 11/1977 | Japan . |
| 53-1240 | 1/1978 | Japan . |
| 54-98869 | 7/1979 | Japan . |
| 57-147471 | 9/1982 | Japan . |

*Primary Examiner*—Willard Hoag

*Attorney, Agent, or Firm*—William D. Blackman; Arnold S. Weintraub

[57] ABSTRACT

A system for automatically painting the external wall of a building, in which a support is suspended from a hoist apparatus disposed on the roof of the building, and a painting apparatus is supported by the support in such a manner as to be movable horizontally. The painting apparatus includes a mechanism for advancing and retracting, in a direction normal to the wall surface, a painting hood having a spray gun disposed therein, a mechanism for swinging the hood laterally, and a frame formed of mounted on the peripheral edge of an opening of the hood which opposes the wall surface. When the painting is positioned opposite the wall surface, the frame is brought into close contact with the wall surface, thereby sealing the painting hood against the wall surface and preventing any scattering of paint mist. Since the painting hood has no rollers, it causes no degradation in the quality of the painted wall surface.

9 Claims, 14 Drawing Sheets

FIG.14
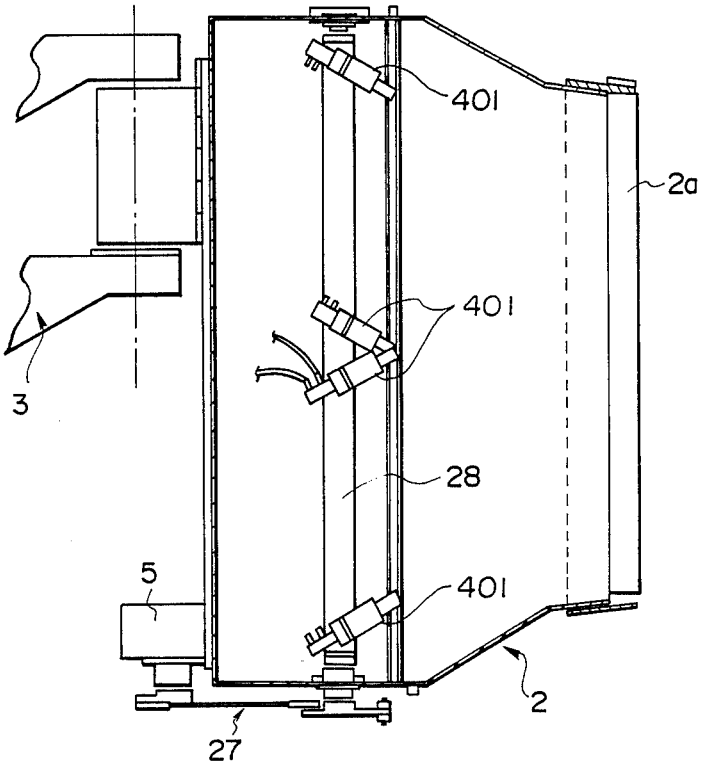
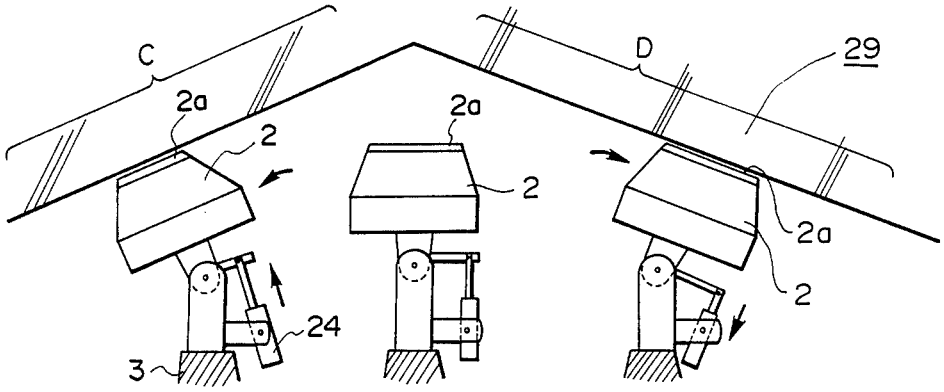
FIG.16(a) FIG.16(b) FIG.16(c)

APPARATUS FOR AUTOMATICALLY PAINTING EXTERNAL WALL OF BUILDING

BACKGROUND OF THE INVENTION

1. Field of the Invention

The present invention relates to a system for automatically painting the external wall of a building, the system being suspended from a hoist apparatus disposed on the roof of the building and paints the outer surface of the external wall while preventing any scattering of paint mist by means of a painting hood.

2. Description of Prior Art

An example of a conventional system for automatically painting the external wall of a building by the same inventors is provided with a painting hood to prevent the scattering of paint mist is disclosed in Japanese Utility Model (Laid-Open) No. 5849/1987.

This system has the following arrangement. Flat rollers and auxiliary rollers are provided on the upper and lower edges at the end of a painting hood facing the outer surface of the external wall to be painted. The painting hood is provided with side rollers which are mounted on side edges at end thereof, which can be automatically advanced and retracted in accordance with the configuration of the surface of the wall. When the automatic painting is performed, the painting hood is brought into close contact with the outer surface of the wall to be painted and is moved laterally or horizontally along the surface of the wall to prevent the scattering of paint mist. Since the rollers are each formed of an elastic, flexible material, the rollers enable the hood to stay in contact with the wall surface, and the rollers enable smooth movement along the wall surface.

Although this conventional painting system enables automatic painting in a continuous manner, the system has several disadvantages. Since the rollers are pressed against the portion of the wall surface that is already painted, marks are formed on the painted wall surface which degrade the quality of the finished surface. Furthermore, the rollers which are formed of a flexible, elastic material become worn after repeated use, causing a gap between the rollers and the wall surface. The gap eventually results in the inadequate suppression of the scattering of the paint mist.

SUMMARY OF THE INVENTION

It is the object of the present invention to overcome these problems by providing various configurations, including an arrangement whereby a painting hood having an elastic and swingable frame is mounted on the peripheral edge of the opening thereof.

The preferred embodiment of the present invention involves a system for automatically painting the external wall of a building comprises a support suspended from a hoist apparatus disposed on the roof of the building, and a painting apparatus supported in such a manner as to be movable in the horizontal direction. The painting apparatus includes a painting hood having a spray gun disposed therein, means for advancing and retracting the painting hood in a direction normal to the outer surface of the external wall, means for swinging the painting hood laterally, and a frame formed of an elastic material and mounted on the peripheral edge of an opening of the painting hood which opposes the outer surface of the external wall.

The support includes a position determining device, and this device may preferably comprise a pair of locating brackets each capable of moving within a guide groove formed on the outer surface of the external wall of the building, a pair of rods extending in the longitudinal direction of the support and having one of their respective ends fixed to the locating brackets, and a locating actuator engaging with the other ends of the rods and capable of moving the rods in the longitudinal direction of the support.

The system may further comprise a vertical position detecting device having a rotor which is in contact with the outer surface of the external wall of the building, which is capable of rotating as the support ascends or descends. The device also has a signal generator for detecting the number of revolutions of the rotor and for generating on the basis of the detected number a signal indicative of the distance which the support has ascended or descended.

The system may further comprise guide groove painting devices each supported by the support and each including a casing opening toward the outer surface of the external wall of the building, a spray gun mounted within the casing and directed toward the inner surface of the guide groove such as to effect spraying thereon, and partition plates which have the same planar configuration as that of the cross-section of the guide groove, which are provided on the casing and which are capable of being moved within the guide groove. The partition plates comprise at least one first partition plate and at least one second partition plate disposed on of the casing, one plate being above and below the position at which the spray gun is mounted in the casing.

The spray gun used in the painting apparatus may be an automatic airless spray gun capable of detecting the on-off condition of paint discharging action in accordance with the reciprocal movement of a needle for opening and closing a discharge port for discharging pressurized paint.

The automatic airless spray gun may comprise a needle having its front end facing a discharge port for discharging pressurized paint which is formed in the main body of the spray gun, means operable to cause the reciprocal movement of the needle for opening and closing the discharge port which enables the discharge of paint, a mechanical valve operable in response to the reciprocal movement of the needle to control the passage of compressed air, and a pressure switch into which compressed air is introduced through the mechanical valve and which outputs a signal indicative of the pressure of the compressed air introduced therein.

The automatic airless spray gun may alternatively comprise a needle having its front end facing a discharge port for discharging pressurized paint which is formed in the main body of the spray gun, means operable to cause the reciprocal movement of the needle for opening and closing of the discharge port which enables the discharge of paint, and switch means operable in response to the reciprocal movement of the needle to output a signal indicative of the condition of movement of the needle.

The automatic painting system of the present invention is suspended from the hoist apparatus disposed on the roof of the building, with the locating brackets of the system being brought into engagement with the guide grooves formed on the outer surface of the external wall of the building. The system is caused to ascend or descend until it is located at a suitable position facing the wall surface to be painted. Subsequently, the painting hood supported and suspended therefrom by the support, is moved in the horizontal direction by moving means until it is positioned at the along the wall surface to be painted. To bring the painting hood closer to the wall surface, the hood is advanced in a direction normal to the wall surface by the advancing-retracting means. If the outer surface of the wall is irregularly shaped (a folding screen a surface with a zigzag configuration, a plurality of obliquely angled surface sections), the painting hood is swung laterally by the swinging means until the hood is brought into a position precisely facing one of the sections of the wall surface. The painting hood is advanced until the frame of the painting hood, which is provided on the peripheral edge of the opening thereof, is brought into press contact with the wall surface section. In this way, since the frame mounted of the painting hood is pressed against the wall surface, the space inside the painting hood is tightly sealed. Therefore, any paint mist is prevented from scattering to the outside of the painting hood.

When this one section of the irregular wall surface has been painted in this way, the painting hood is retracted by the advancing-retracting means. The painting hood is then brought into a position precisely facing another section of the irregular wall surface by the swinging means. Thereafter, the hood is again advanced by the advancing-retracting means to be brought into press contact with the subsequent section of the irregular wall surface, and painting is performed in a similar manner. These operations are repeated until the painting has been completed.

The automatic painting system may include a position determining device in which locating brackets are movable in the longitudinal direction of the support. The locating brackets are moved in pairs until that part of the wall surface defined between two guide grooves is interposed between these brackets, with no gap left between the guide grooves and the brackets, whereby the position of the support relative to the outer surface of the external wall is accurately determined.

The automatic painting system may include a distance sensor capable of measuring distance by means of a rotor. The rotor rotates as the support is ascending or descending, and the distance which the support has moved is measured by detecting the number of revolutions of the rotor, whereby the vertical position of the support can be detected.

The automatic painting system may include guide groove painting devices provided on the support. These guide groove painting devices move together with the support along the guide grooves, and paint the inner surface of the grooves. Hence the inner surface of the guide grooves, which the main painting apparatus of the system can only paint with difficulty, will not be left unpainted. During painting, the guide groove partition plates fixed to each device and at positions above and below the spray gun act to prevent any scattering of paint mist, these partition plates comprising at least one upper plate and at least one lower plate.

If the spray gun is an automatic airless spray gun in which the on-off condition of the discharging action of the spray gun can be detected, a signal indicative of the open-close condition of the paint discharge port of the spray gun is output by the pressure switch or the switch means which is operable via the valve means or directly in response to the reciprocal movement of a needle, whereby the condition of paint discharging action is detected.

BRIEF DESCRIPTION OF THE DRAWINGS

FIG. 14 is a side sectional view of the painting hood;

FIGS. 16(*a*), 16(*b*), and 16(*c*) are views showing movement of the hood;

DETAILED DESCRIPTION OF THE PREFERRED EMBODIMENT

The present invention will initially be described hereunder with reference to the accompanying drawings, FIGS. 1 through 16, which depict the preferred embodiment automatic painting system of the present invention.

Figure 1:
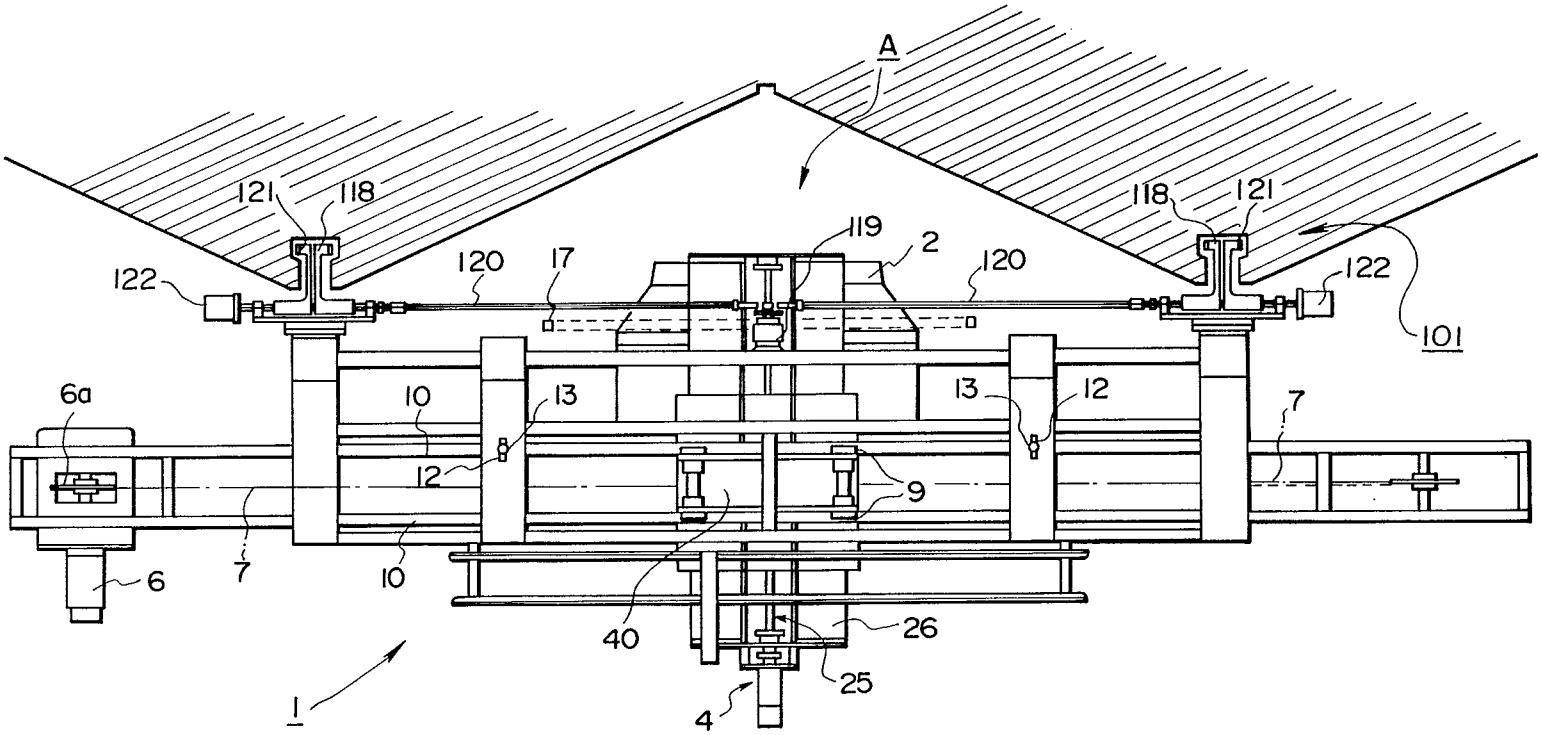
FIG. 1 is a plan view of an automatic painting system in accordance with the present invention.
Figure 2:
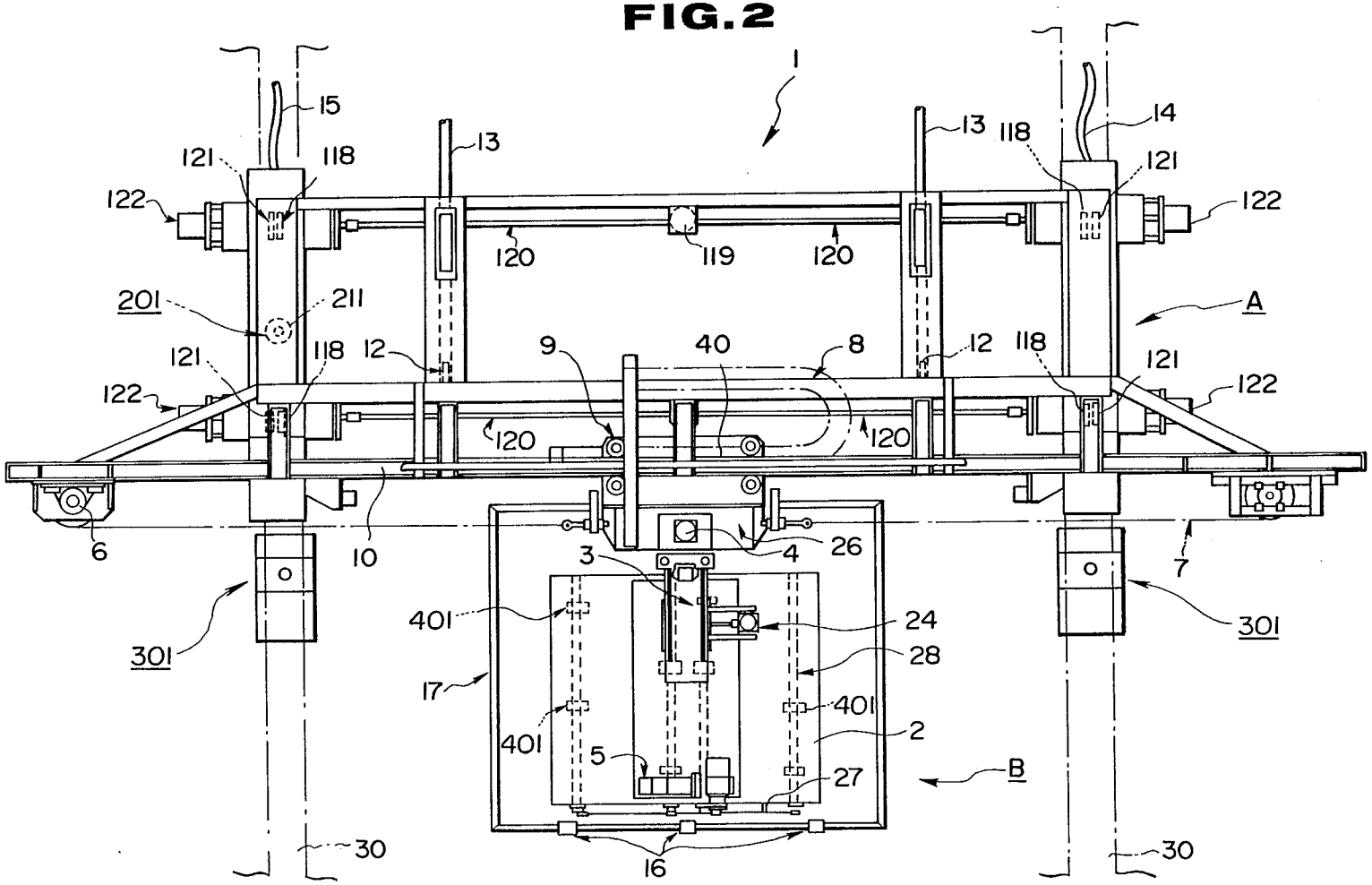
FIG. 2 is a front view of the automatic painting system.
Figure 3:
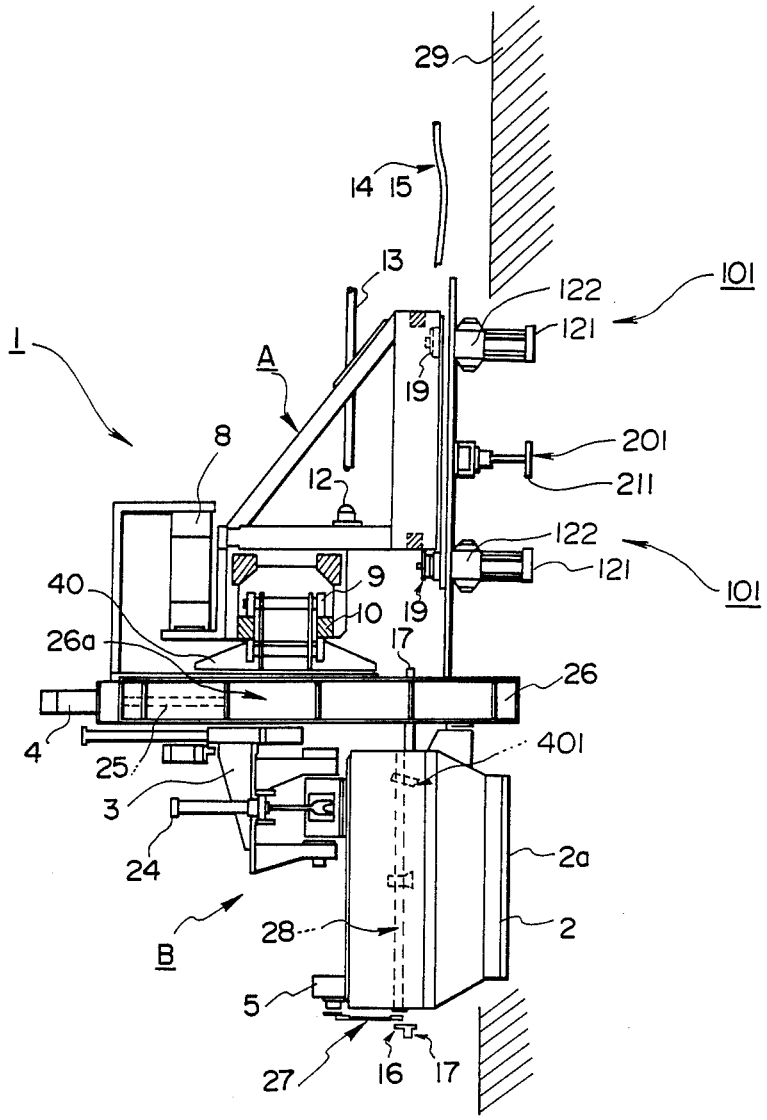
FIG. 3 is a side sectional view of the automatic painting system.

FIG. 1 is a plan view of an automatic painting system 1, FIG. 2 is a front view of the system, and FIG. 3 is a side sectional view of the system. The overall construction of the automatic system will be described with reference to these drawings.

Figure 15:
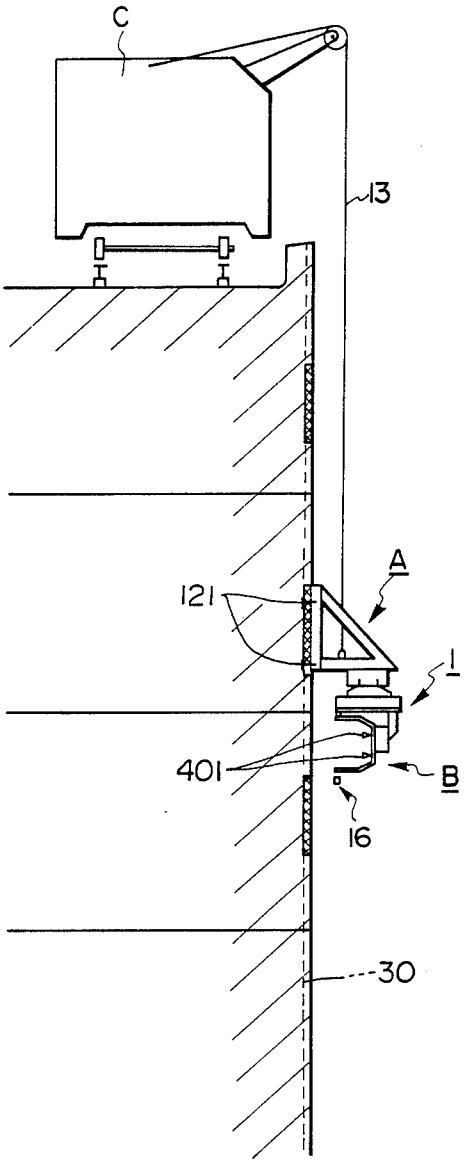
FIGS. 15(*a*) and 15(*b*) are views depicting the roof car, the support, and the painting apparatus of the automatic painting system is used.
Figure 15:
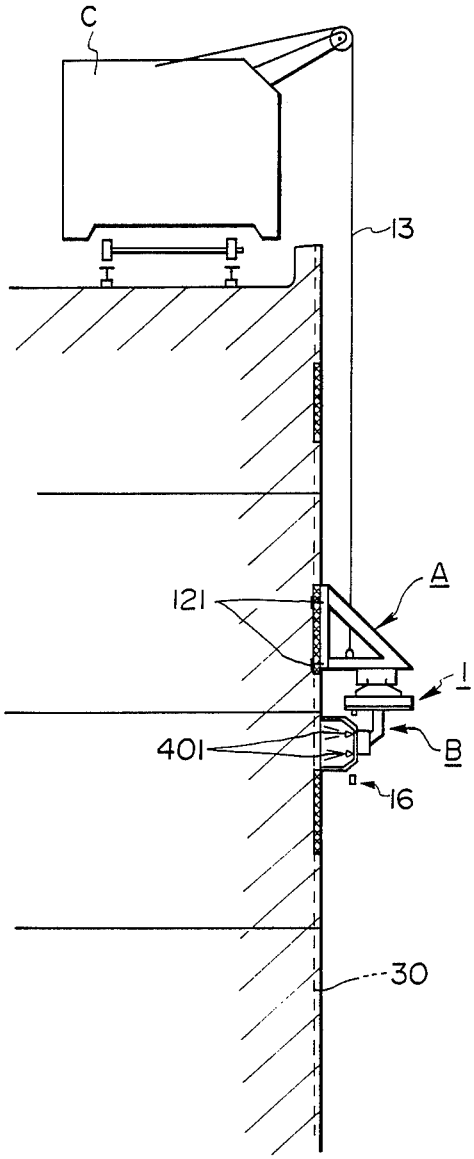

The automatic painting system 1 comprises a support A and a painting apparatus B, and is suspended from and is thus supported by a roof car C which serves as a hoist apparatus and is disposed upon the roof of a building, as shown in FIGS. 15.

The support A has its engagement members 12 engaged with one end of a rope 13 suspended from the roof car C, whereby the support A is suspended from the roof of the building. The painting apparatus B is suspended from the lower portion of the support A, and various devices for performing operation, such as a control device and an air supply device (none of which are shown) are mounted on support A. The support A has various devices in addition to the mechanism for suspending the painting apparatus B, and they include position determining devices 101 for positioning the support A at a predetermined position relative to an outer surface 29 of the external wall of the building, a vertical position detecting device 201 which detects the distance which the support A has moved vertically so as to detect the position of the support A, and guide groove painting devices 301 for painting the inner surface of guide grooves which will be left unpainted after the painting operation of the painting apparatus B.

The position determining devices 101, each having exactly the same construction, are disposed on that surface of the support A opposing the outer surface 29 of the wall and are disposed in two rows which are vertically apart.

Figure 4:
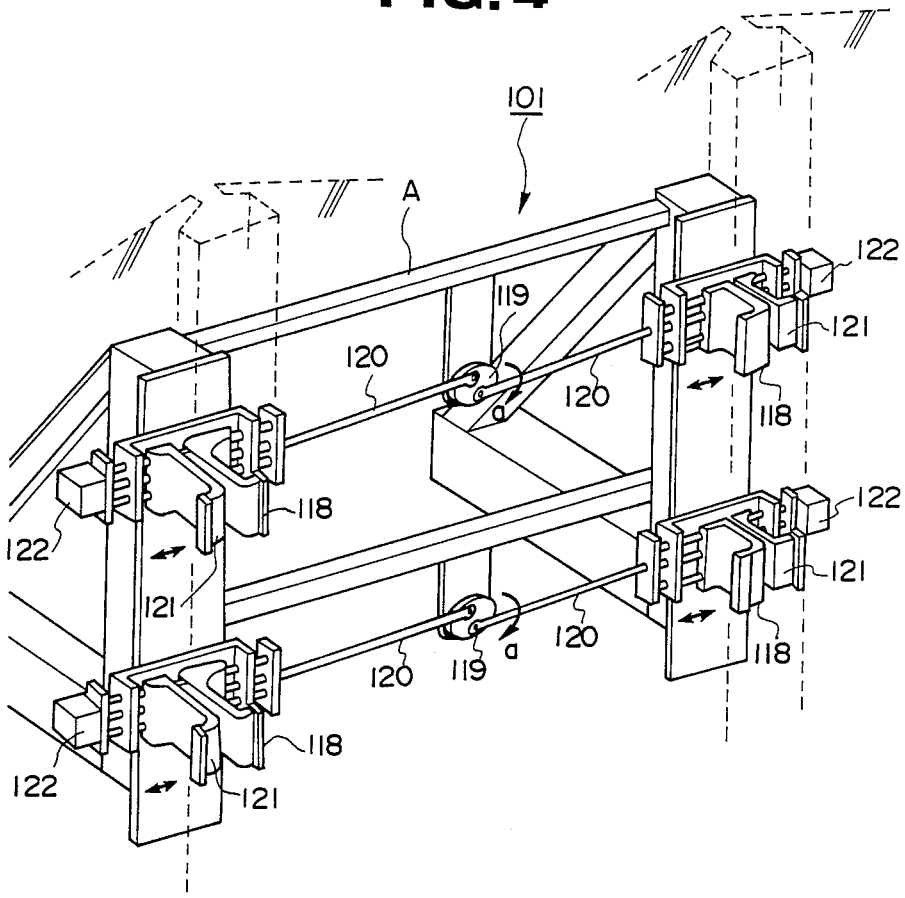
FIG. 4 is a perspective view of position determining devices of the system.
Figure 5:
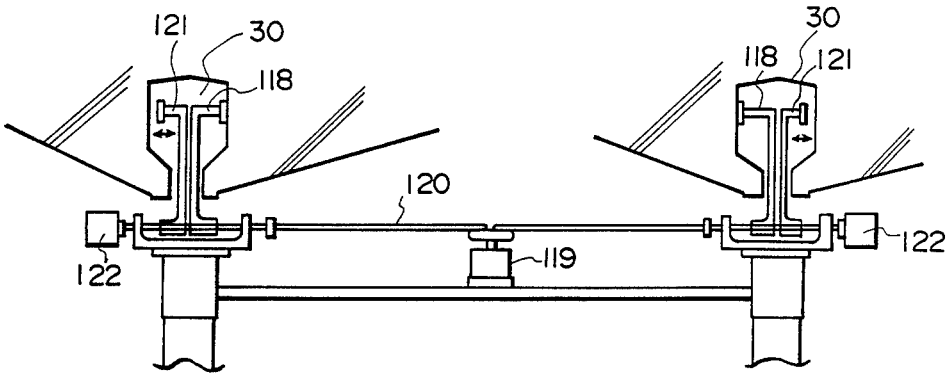
FIG. 5 is a plan view of the position determining devices.

FIG. 4 is a perspective view of the position determining devices 101, and FIG. 5 is a plan view of the devices 101. Each of the position determining device 101 includes a locating actuator 119 provided in the center of the support A in the longitudinal direction thereof (i.e., in the horizontal direction), a pair of locating brackets 118 each engaging with a guide groove 30 formed on the wall surface 29, and a pair of rods 120 having the same length and connecting the locating actuator 119 to the locating brackets 118. Specifically, the rods 120 have one of their respective ends supported by the face of a round plate forming the locating actuator 119 in such a manner that these ends are rotatable symmetrically with respect to the center of the plate. The other ends of the rods 120 are fixed to the corresponding locating brackets 118. Accordingly, when the locating actuator 119 is rotated forward or backward, the interval between the pair of locating brackets 118 can be adjusted as desired. When this interval is narrow, the locating brackets 118 at either end of the interval cooperage with each other to hold therebetween that portion of the wall surface 29 which is defined between adjacent guide grooves 30, without any gap being left between the inner surface of the grooves 30 and the brackets 118. In this way, it is possible to prevent any vibration of the support A. On the other hand, when this interval is wider, the locating brackets 118 are kept from coming into contact with the inner wall of the grooves 30. In this way, when the support is ascending or descending, damage of the inner surface of the grooves 30 is prevented.

A pair of fixing brackets 121 are disposed in correspondence with the locating brackets 118 and on that side of the brackets 118 which is remote from the center of the support A. When fixing actuators 122, associated with the fixing brackets 121, are driven, the fixing brackets 121 are moved outwardly as shown in FIG. 4, until the tip portions of the brackets 121 press against the inner wall of the guide grooves 30 at a predetermined pressure, thereby enabling the automatic painting system to be fixed to the wall surface 29 at a predetermined position thereon. Since each of the locating brackets 118 and the fixing brackets 121 is arranged to come into press contact with the inner surface of the guide grooves 30, members formed of hard rubber or the like are mounted on the tip portions of the brackets 118 and 121 avoid any damage of the inner surface. Air is supplied to the locating actuators 119 and the fixing actuators 122 by means of an air compressor (not shown) provided on the automatic painting system 1.

One vertical position detecting device 201 is provided at a central position on the left side (as viewed in FIG. 2) of the support A. The vertical position detecting device 201 is in engagement with a guide groove 30 formed on the wall surface 29 so that, when the system 1 is ascending or descending, the device 201 guides the system 1 along the guide groove 30 and enables the position of the automatic painting system 1 to be checked on the basis of the number of revolutions of a rotor 211 of the device 201.

Figure 6:
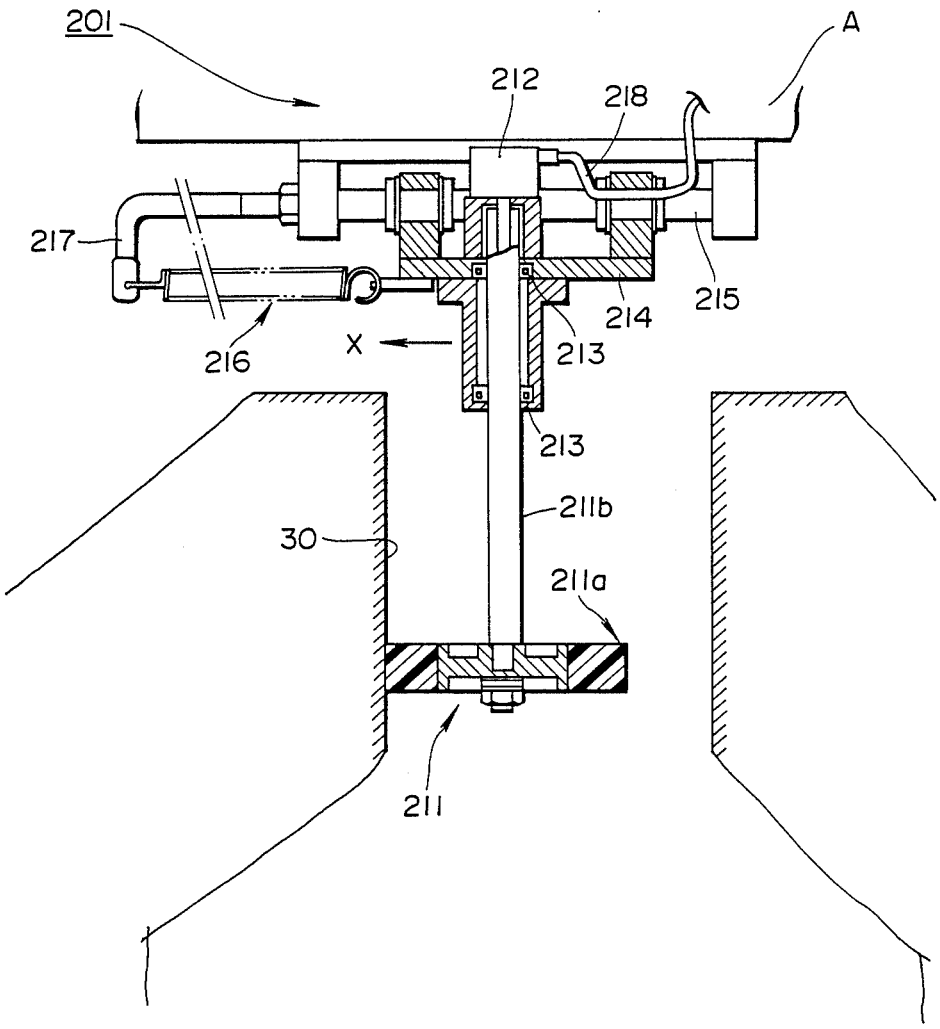
FIG. 6 is an enlarged sectional view of a vertical position detecting device.

FIG. 6 is an enlarged sectional view of the vertical position detecting device 201. The device 201 includes the rotor 211 rotatably supported by the support A in such a manner as to contact the inner wall of the guide groove 30. An encoder 212 uses the number of revolutions of the rotor 211 to calculate the vertical position of the support A, and generates a signal indicative of the calculated position.

The rotor 211 comprises a wheel **211*a* having its circular peripheral surface kept in contact with a side wall of the inner surface of the guide groove 30, and a shaft 211*b* extending from the center of the wheel 211*a* toward the support A. The shaft 211*b* for the rotor 211*a* is rotatably supported by a supporting frame 214 via all bearings 213. The supporting frame 214 slidably engages with a slide bar 215** mounted to the support A.

A tensile spring 216 is interposed between the supporting frame 214 and a mounting arm 217 fixed to the support A. The spring 216 always urges the supporting frame 214 in the direction indicated by an arrow X, thereby pressing the wheel **211*a* of the rotor 211 against the inner wall of the guide groove 30. The outer peripheral portion of the wheel 211*a* is formed of an elastic material such as urethane or rubber so that the wheel 211*a* is capable of rotating, without slipping, while it is in positive contact with the inner wall of the guide groove 30 as the automatic painting system 1** is ascending or descending.

The rotation of the rotor 211 is sensed by the encoder 212, which, on the basis of the known length of the outer circumference of the wheel **211*a*, calculates the distance the wheel 211*a* has traveled and detects the position of the automatic painting system 1. A signal indicative of this position is generated by the encoder 212 and is transmitted to the roof car C via a cable 218. In this way, the automatic painting system 1** is automatically moved to a predetermined position, in accordance with a set program.

A pair of guide groove painting devices 301, each having exactly the same structure, are fixed to lower portions of the support A in such a manner as to correspond to two adjacent guide grooves 30.

Figure 7:
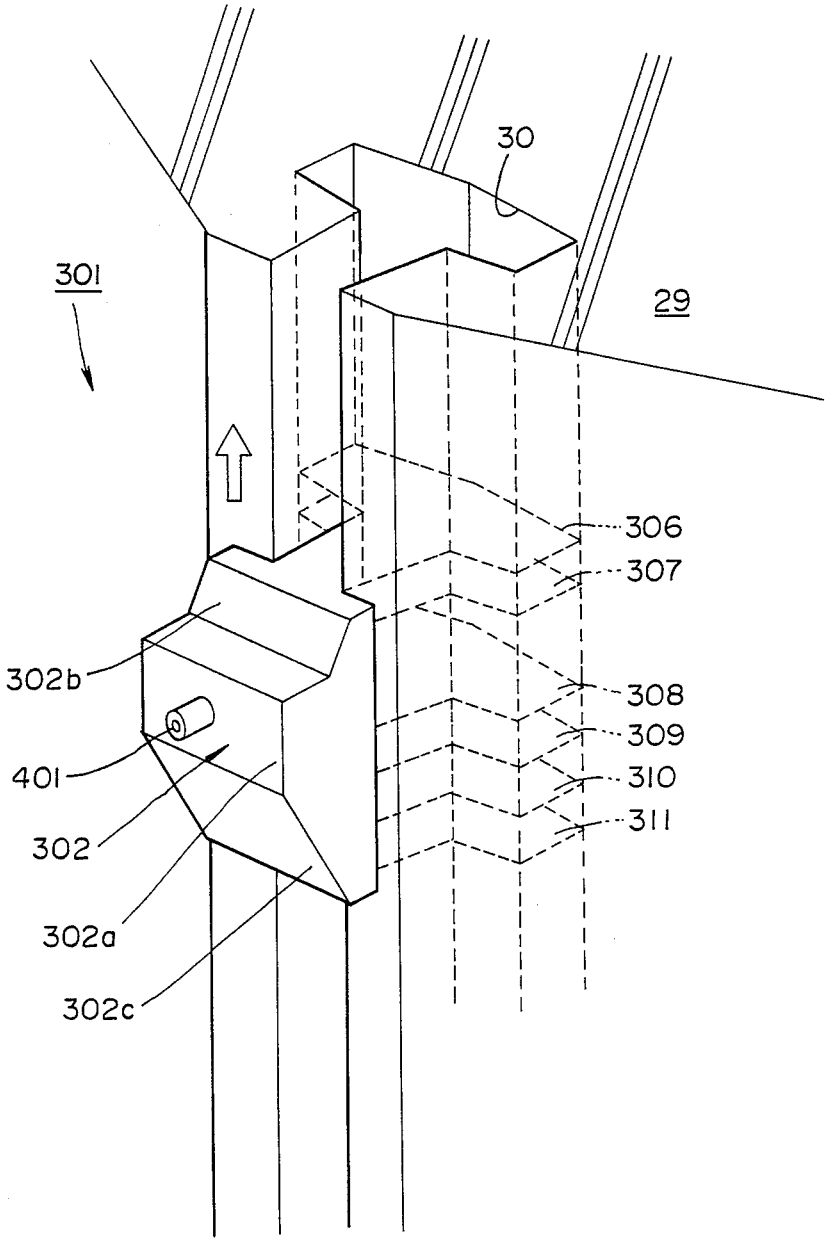
FIG. 7 is a perspective view of a guide groove painting device.
Figure 8:
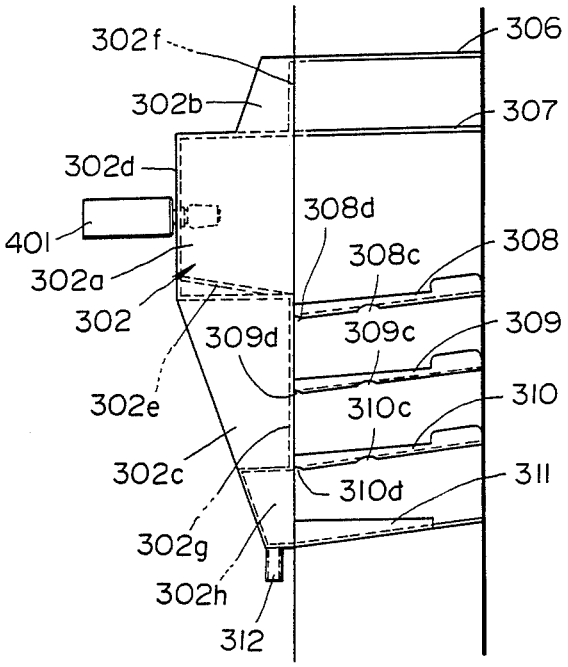
FIG. 8 is a side view of the guide groove painting device.
Figure 9:
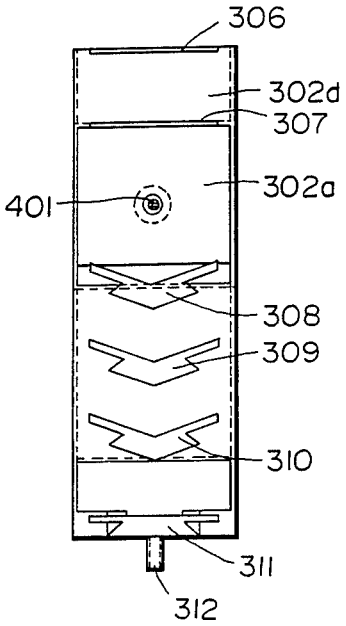
FIG. 9 is a front view of the guide groove painting device.
Figure 10:
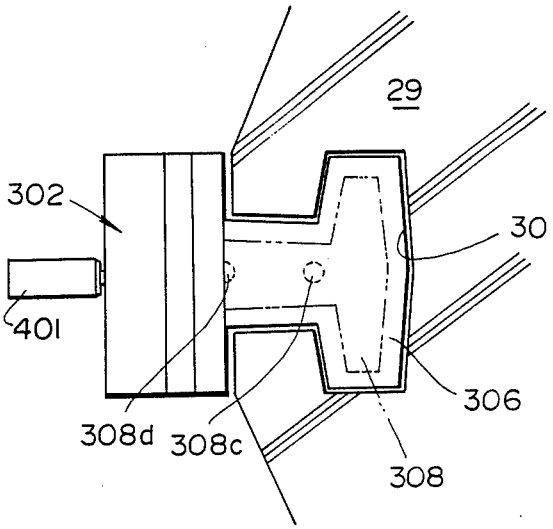
FIG. 10 is a plan view of the guide groove painting device.

FIG. 7 is a perspective view of each of the guide groove painting devices 301, FIG. 8 is a side view of the device, FIG. 9 is a front view of the device, and FIG. 10 is a plan view of the device. As best shown in FIG. 7, each guide groove painting device 301 mainly comprises a casing 302, partition plates 306 to 311, and a spray gun 401. The casing 302 comprises a casing central portion **302*a* projecting toward its center, a casing upper portion 302*b* forming a step in cooperation with the central portion 302*a* and depressed therefrom, and a casing lower portion 302*c* gradually sloping from the central portion 302*a***.

As shown in FIGS. 8, 9 and 10, the casing central portion **302*a* has a rear plate 302*d* disposed in parallel with the front face of the corresponding guide groove 30, and plates disposed in the space between the rear plate 302*d* and the front face of the guide groove 30 in such a manner as to surround the vertical and horizontal sides of the space and define an opening on the face of the portion 302***a* which opposes the guide groove 30. The spray gun 401 is fixed to the rear plate 302*d* and has a paint discharge port directed to the inside of the casing central portion 302*a* to the inside of the guide groove 30.

The casing upper portion 302*b* has a contact plate 302*f* provided on that face of the portion 302*b* which opposes the guide groove 30. First partition plates 306 and 307 are fixed to the front surface of the contact plate 302*f*. Each of the first partition plates 306 and 307 are flat plate having a generally T-shaped planar configuration approximating the cross-sectional configuration of the inside of the guide groove 30. The partition plates 306 are inserted in the guide groove 30 and are capable of being moved vertically in the groove 30.

Similarly, the casing lower portion 302*c* has a contact plate 302*g* provided on that face of the portion 302*c* which opposes the guide groove 30. Second partition plates 308, 309, 310, and 311 are fixed to the front surface of the contact plate 302*g*.

In contrast to the first partition plates 306 and 307, partition plates 308, 309, and 310 each have a trough line which is formed in a central portion thereof that is at the widthwise center of the guide groove 30, and along which the plate is lowest. Also, partition plates 308, 309, and 311 each decline toward the casing 32. Partition plates 308, 309, and 310 each have through holes formed therein. Specifically, a through hole 308*c*, 309*c* or 310*c* is formed in an intermediate portion of the trough line, and a through hole 308*d*, 309*d* or 310*d* is formed in the base portion thereof where partition plates 308, 309, and 310 are fixed to the contact plate 302*g*. The partition plate 311 extends to a space 302*h* formed within the casing lower portion 302*c*.

When paint is ejected from the spray gun 401, the flow of paint mist is blocked by the first partition plates 306 and 307 as well as the second partition plates 308, 309, 310, and 311, and is prevented from scattering to the outside. Furthermore, even if, during a painting operation, some of the paint mist attached to the second partition plates 308, 309, and 310 gathers thereon, the some paint flows along wing the trough lines formed in the center of the partition plates 308 to 310, then flows into the through holes 308*c* to 310*c* and 308*d* to 310*d*, and further flows on the partition plate 310. Some paint is thus allowed to reach the space 302*h* within the casing 302, from which it is collected through an outlet 312 by a waste paint tank (not shown) provided outside. In addition, some paint disposed on the inner wall of the casing central portion 302*a* flows on a bottom plate 302 declining toward the opening of the portion 302*a*, and it is then collected in a similar manner, i.e., through the space 302*h* and by the waste paint tank.

Figure 11:
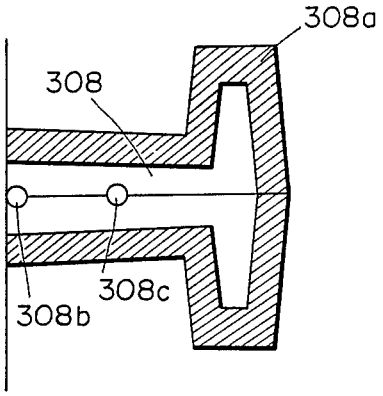
FIG. 11 is a plan view of a partition plate.

As shown in FIG. 11, a buffer member 308*a* formed of a flexible material, such as urethane or rubber, is secured to the peripheral portion of the second partition plate 308. This arrangement makes it possible to reduce the risk of the surface already painted becoming damaged even when, during the movement of the guide groove painting device 301, the partition plate 308 contacts a portion of the inner surface of the guide groove 30 which is already painted. Although not shown in FIG. 11, a buffer member, such as that described above, is also mounted on the peripheral portion of each of the other second partition plates 309, 310, and 311.

The guide groove painting devices 301 are mounted on the lower portion of the support A. This is because it is assumed, in this embodiment, that the automatic painting system 1 performs a painting operation from a position of the building to an upper position thereof, and because it is necessary to prevent the locating brackets 118 or the like from causing any damage to that portion of the surface which is already painted. However, in the case where the automatic painting system 1 performs painting downwardly from an upper portion, the guide groove painting devices 301 are mounted on the upper portion of the support A. Further, the guide groove painting devices 301 may not necessarily be provided on the automatic painting system 1. Alternatively, a single groove painting device may be used while it is suspended from the roof car.

As depicted in FIGS. 1, 2, and 3 the painting apparatus B includes a painting hood 2 having a number of paint spray guns 401 disposed therein, and a plurality of mechanisms for moving the painting hood 2 in various directions.

The painting hood 2 is supported by a carriage 40 via a hood supporting device 3 and a supporting beam 26. Specifically, the carriage 40 has two pairs of wheels 9 which each engage a pair of guide rails 10 of the support A, whereby the carriage 40 is disposed in engagement with the support A. When the carriage 40 is moved on the guide rails 10 by a hood horizontal movement motor 6 provided on one of respective ends of the guide rails 10 via sprockets 6*a* coaxial with the motor 6 as well as a chain 7 in meshing engagement with the sprockets 6*a*, the painting hood 2 is moved horizontally together with the hood supporting beam 26 fixed to the carriage 40. Furthermore, when a ball screw 25 provided in the hood supporting beam 26 is driven forward or backward by a hood advancing-retracting motor 4, the painting hood 2 is advanced toward or retracted from the wall surface 29 of the building.

A hood swinging cylinder 24 is mounted on the hood supporting device 3 and is operable in accordance with the angle stored in the control device (not shown) which is mounted on the automatic painting system 1 so as to cause swinging of the hood 2. Accordingly, the hood 2 is positioned to face directly a surface C or D to be painted, as shown in FIGS. 16 (*a*) to (*c*).

The painting hood 2 can be moved freely within a certain space by combining three types of movement caused by the operation of at least two mechanisms. By virtue of this arrangement, even when the support A is not at a position directly facing the wall surface 29, the painting hood 2 can be easily brought into contact with the wall surface 29.

A cable bearer 8 is provided on the carriage 40 at a location above the painting apparatus B, as shown in FIG. 2. The cable bearer 8 is provided to support members such as a hose for supplying paint to the painting hood 2, and cables for supplying electricity to various drive mechanisms. End portions of a paint hose 14 extending from the automatic painting system 1 to the roof car C and a power cable 15 are inserted into the cable bearer 8 and protected thereby. A distance sensor 16 is disposed a lower end of a metal frame 17 of the painting hood 2 to detect the distance between the wall surface 29 and the painting hood 2.

Figure 12:
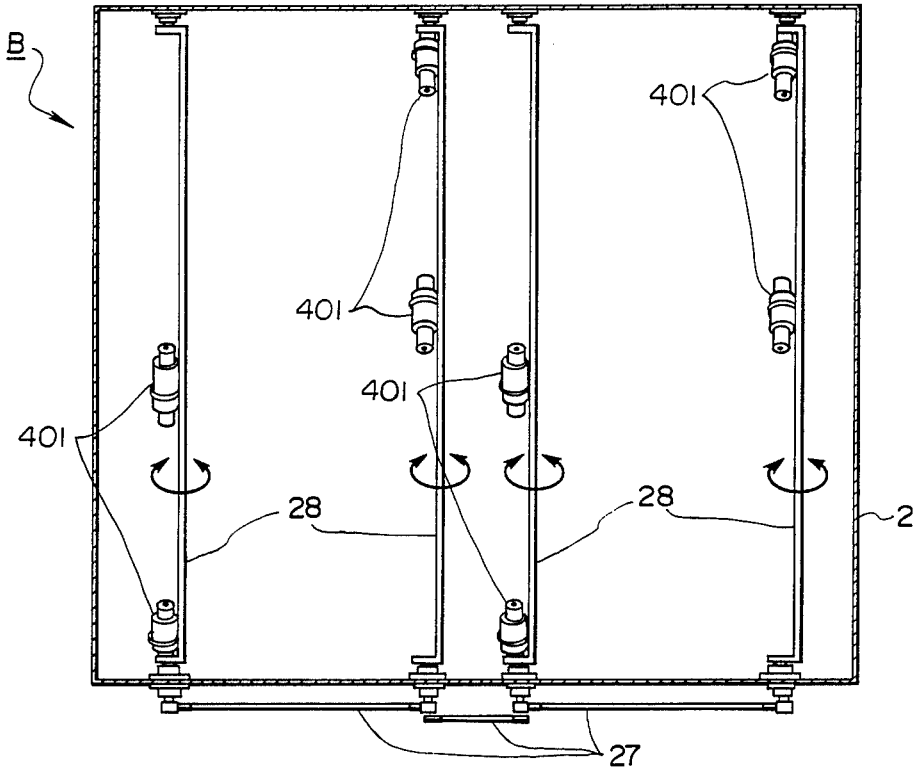
FIG. 12 is a front sectional view of a painting hood.
Figure 13:
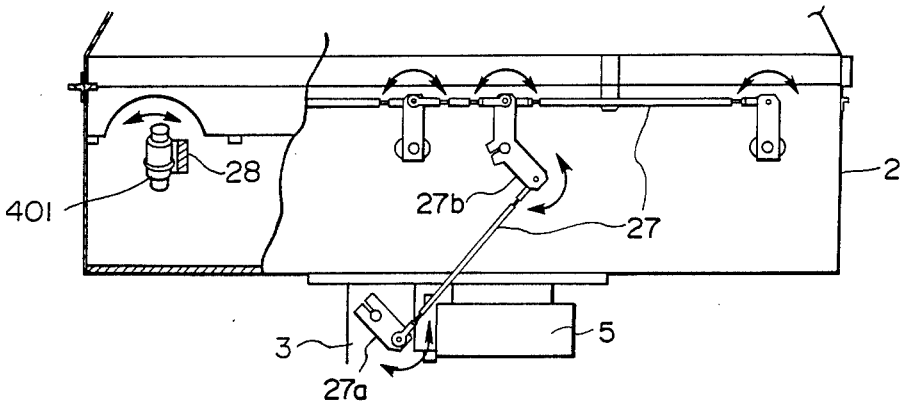
FIG. 13 is a plan view of the painting hood.

FIG. 12 is a front sectional view of the painting hood 2, FIG. 13 is a plan sectional view of the painting hood 2, and FIG. 14 is a side sectional view of the painting hood 2.

A gun swinging motor 5 is provided for the painting hood 2, with four shaft plates 28 linked with the motor 5 via rods 27 and cranks 27*a* and 27*b*, and a plurality of spray guns 401 each mounted on the corresponding shaft plates 28. When the shaft plates 28 are rotated via the rods 27, the spray guns 401 are repositioned. By virtue of this mechanism, the painting hood 2 is capable of ensuring a satisfactory thickness of a paint film even when the external wall to be painted has an irregular surface, e.g., a surface formed of masonry. On the peripheral edge of the opening of the painting hood 2, a frame 2*a*, formed of an elastic material such as rubber or synthetic resin, is mounted.

As shown in FIGS. 15 (*a*) and (*b*), the automatic painting system 1 is suspended from the roof car C disposed upon the roof of the building. The system 1 ascends and descends until it is positioned at and stopped at a painting position. During this ascending and descending operation, since the locating brackets 118 and the fixing brackets 121 of the position determining devices 101 of the support A are engaged within the guide grooves 30, the automatic painting system 1 can be vertically moved along the guide grooves 3 and without any vibration. When this condition of the system 1 has been achieved, first, the locating actuators 119 are rotated in the direction indicated by arrows a (see FIG. 4), whereby the locating brackets 118 are moved in pairs in the direction in which the interval therebetween is narrowed, with their tip portions being brought into press contact with the inner walls of the guide grooves 30 with a predetermined pressure. At this time, because the rods 120 have equal lengths, and because the locating actuators 119 are each provided in the center of the longitudinal direction of the support A, the center of the wall surface section defined between the adjacent grooves 30 coincides with the longitudinal center of the support A. Subsequently, the fixing actuators 122 are operated to move the fixing bracket 121 in the direction opposite to the movement of the locating brackets 118, whereby the fixing brackets 121 are brought into press contact with the inner walls of the guide grooves 30 with an adequately strong pressure. Consequently, the locating brackets 118 and the fixing brackets 121 are brought into frictional engagement with the inner walls of the guide grooves 30, whereby the support A is firmly affixed to the wall surface 29.

The position at which the automatic painting system 1 is stopped is automatically determined by the control device on the basis of an information signal from the vertical position detecting device 201.

Subsequently, a determination is made whether the surface of the building which the system is currently facing is the surface of a window or a louver which is outside the painting range or a part of the wall surface 29 which will be painted. This determination is made on the basis of the distance measured by the distance sensor 16 provided on the metal frame 17 as from the sensor 16 provided on the metal frame 17 as from the sensor 16 to the surface the system 1 is facing. When it is confirmed that the surface the system 1 is facing is to be painted, the painting hood 2 is horizontally moved by sliding the carriage 40 until the hood 2 is positioned at a predetermined position, and the surface is painted.

When a painting operation is to be performed, first, the opening of the painting hood 2 is brought into a position precisely facing a portion of the wall surface to be painted.

For instance, it is assumed that painting operations are to be performed on sections of a zigzag-shaped surface 29 of the external wall of a building, such as those shown in FIGS. 16 (*a*) and (*b*). When the painting hood 2 is to be brought into a position directly facing the surface section C shown in FIG. 16 (*a*), the hood swinging cylinder 24 is driven to change the angle of the painting hood 2 relative to the wall surface 29, until the hood 2 assumes the condition shown in FIG. 16 (*a*). Subsequently, the hood advancing-retracting motor 4 is driven to advance the painting hood 2 toward the surface section C until the frame 2*a* provided on the peripheral edge of the opening of the hood 2 contacts with the surface section C. The distance which the painting hood 2 travels during its advance is controlled on the basis of a detection signal from the distance sensor 16. Since the frame 2*a* is formed of a flexible elastic material, as already described, it is possible to achieve airtight contact between the painting hood 2 and the wall surface 29 even if the wall surface 29 is irregular, thereby enabling the prevention of any paint mist leakage.

Subsequently, the painting action of the spray guns 401 is started. During this action, when the gun swinging motor 5 is driven, the shaft plates 28, via the rods 27, are rotated in either of two directions through a certain angle (about 90 degrees in this embodiment), thereby causing swinging of the plurality of spray guns 401 mounted on the shaft plates 28. The swinging angle can be set to any desired value by suitably selecting such dimensions as the lengths of the rods 27, and the cranks 27*a* and 27*b*.

The painting of the surface section C is continued while the painting hood 2 is horizontally moved within the surface section C by combining the operation of the hood advancing-retracting motor 4 and the hood horizontal movement motor 6. When this painting at the stop position of the support C has been completed, the painting hood 2 is retracted and is then brought into the condition shown in FIG. 16(B). Thereafter, the swinging cylinder 24 is driven in such a manner as to bring the hood 2 into the condition shown in FIG. 16 (*c*) where the hood 2 directly faces section D of the wall surface 29, which is thereafter painted.

When the painting of the surface sections C and D at the stop position of the support A has been completed in this way, the automatic painting system 1 is moved to a subsequent painting position where a similar horizontal painting operation will be performed. The above-described processes are repeated until the painting of the desired portion of the wall surface 29 is completed.

After the wall surface 29 has been painted, the guide groove painting devices 301 are moved together with the automatic painting system 1 to paint the inner surface of the guide grooves 30, thereby painting the inner walls of the guide grooves 30. The painting operation by the guide groove painting devices 301, however, may alternatively be performed in parallel with the painting of the other positions of the wall surface 29.

Figure 17:
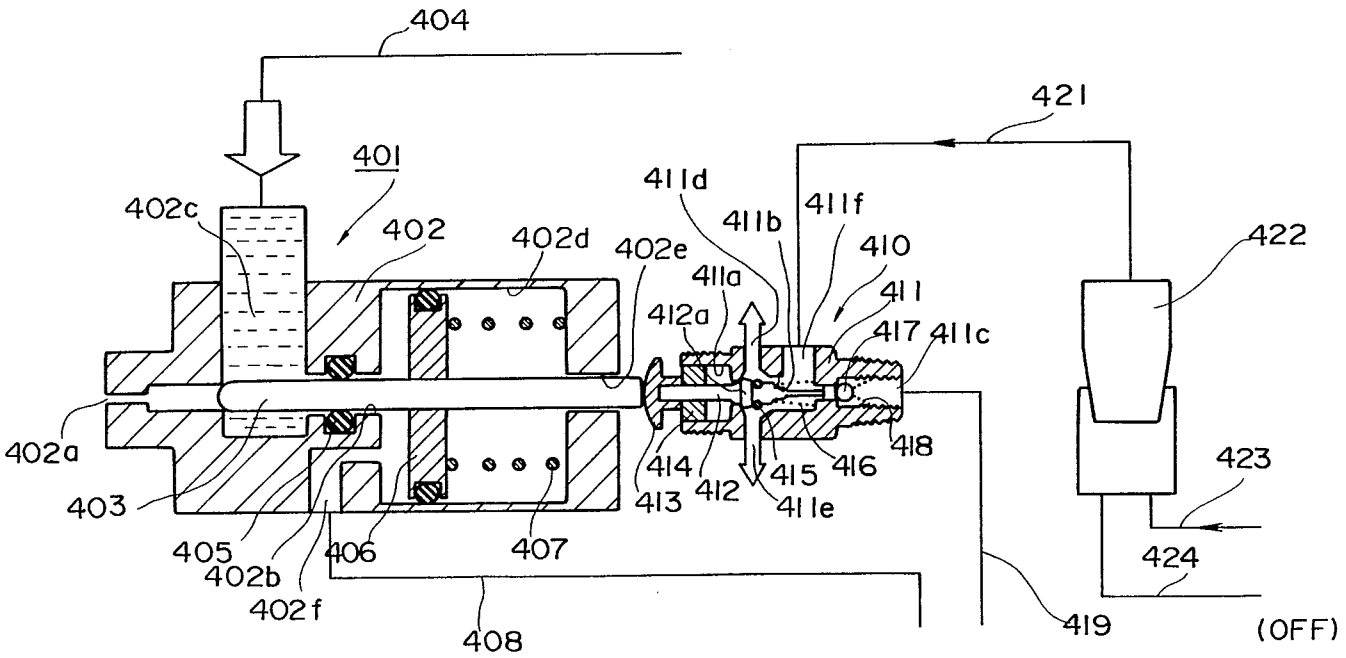
FIG. 17 is a sectional view showing an example of a spray gun.

As shown in FIG. 17, an airless-type automatic spray gun 401 has a main body 402, which is shown on the left side of the drawing. A paint discharge portion 402*a* and a needle hole 402*b* communicating therewith are formed in the front end portion of the gun 401. On one side of the front end portion, a supply port 402*c* is formed to supply pressurized paint, which communicates with the needle hole 402*b*. A piston chamber 402*d* is formed at the rear of the needle hole 402, A front end portion of the piston chamber 402*d* communicates with an air inlet 402*f* opening in a side surface of the main body 402. A needle projection hole 402*e* which opens in the rear end face of the main body 402 is formed at the rear of the piston chamber 402*d*. A piston 406 to which a needle 403 is affixed, is received within the piston chamber 402*d*. The piston 406 is urged toward the front end of the main body 402 by a spring 407 disposed within the rear section of the piston chamber 402*d*. The needle 403, which extends across the needle hole 402*b*, the piston chamber 402*d*, and the needle projection hole 402*e*, is also urged together with the piston 406. Accordingly, during the normal state of the needle 403, the front end of the needle 403 abuts against the paint discharge port 402*a*, thereby blocking the communication between the discharge port 402 and the paint supply port 402*c*. An O-ring is disposed around the outer periphery of the needle 403 at a rear end portion of the needle hole 402*b*, thereby preventing the paint within the needle hole 402*b* from leaking into the piston chamber 402*d*.

The air inlet 402*f* is connected to an air supply pipe 408 through which compressed air is supplied to the inlet 402*f* from an air compressor (not shown). The condition in which air is being supplied is not shown.

A mechanical valve 410 is disposed at the rear of the main body 402 of the spray gun 401. The mechanical valve 410 has a main body 411, and a sealing hole 411*a*, a main shaft hole 411*b* and an air inlet 411*c*, which are continuously formed along the central axis of the main body 411 from the front end thereof (on the left side of the main body 411 as viewed in FIG. 17) to the rear end. Air flow outlets 411*d* and 411*e* which are normal to the central axis of the main body 411 extend from a side surface portion of the main body 411 to the opposite side surface portion of the main body 411 to the opposite side surface portion and cross the main shaft hole 411*b*. An air connection port 411*f* extending parallel with the air flow outlet 411*d* opens in another side surface portion of the main body 411 and communicates with the main shaft hole 411*b* in a similar manner.

A main shaft 412 is received in the sealing hole 411*a* and the main shaft hole 411*b* in such a manner as to be movable along the central axis. A button 413 is fixed to the front end of the main shaft 412 and is disposed in such a manner as to abut against the rear end face of the needle 403. A ring-shaped sealing member 414 is fitted in the gap between the main shaft 412 and the main body 411.

The main shaft 412 has a peripheral projection 412*a* formed around the outer periphery of the main shaft 412 which is in contact with the air flow outlets 411*d* and 411*e*. A packing 415 is disposed at the rear of the projection 412*a*. The main shaft 412 is urged toward the front end of the valve 411 by a spring 416 disposed at the rear of the peripheral projection 412*a*. The rear end portion of the main shaft 412 projects into the air inlet 411*c*, and a ball 417 is provided at the rear end of the main shaft 412. The ball 417 is urged toward the main shaft 412 by a spring 418, so that the communication between the air inlet 411*c* and air connection port 411*f* is blocked normally by the ball 417. The air inlet 411*c* is connected via an air supply pipe 419 to an air compressor, not shown.

The air connection port 411*f* is connected via an air connection pipe 421 to a pressure switch (pneumatic relay) 422 having a diaphragm. The pressure switch 422 in turn is connected to a power line 423 and a signal line 424. When the pressure of air within the pressure switch 422 is high, the signal transmitted via the signal line 424 is at high level. In this way, the relay 422 acts to output a signal indicative of the level of the internal pressure. The signal transmitted through the signal line 424 is displayed by the above-mentioned display.

No compressed air is supplied through the air supply pipe 408. The front end of the needle 403 is urged by the spring 407, abuts against the paint discharge port 402*a*, and closes the discharge port 402. Accordingly, even if paint under pressure is delivered through the paint supply port 402*c*, no paint is ejected from the discharge port 402*a*.

The main shaft 412 of the mechanical valve 410 is urged to the front side by the spring 416, thereby opening the air flow outlets 411*d* and 411*e*. Conversely, the ball 417 is pushed by compressed air supplied through the air supply pipe 419, thereby closing the air inlet 411*c*. With the above-described condition, therefore, part of the air within the pressure switch 422 escapes through the air flow outlets 411*d* and 411*e*, thereby causing a drop in the internal pressure of the switch 422, which in turn causes a low-level signal to be transmitted via the signal line 424. Hence, the status of the spray gun 401 is detected on the basis of data displayed by the display, i.e., data indicating that the signal transmitted via the signal line 424 is at low level.

Figure 18:
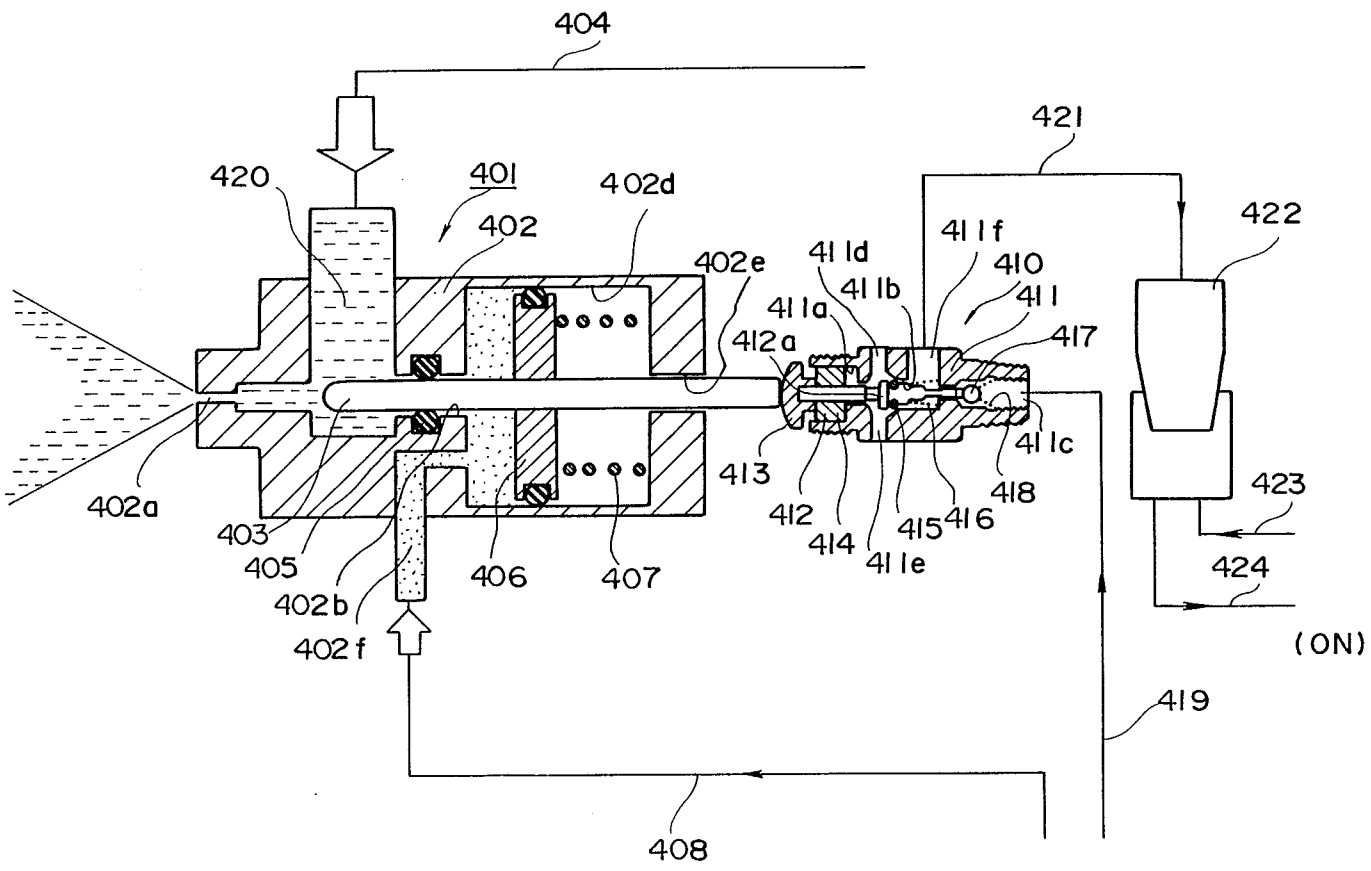
FIG. 18 is a sectional view showing the operation of the spray gun shown in FIG. 17.

In FIG. 18, compressed air is supplied into the piston chamber 402*d* through the air supply pipe 408 and through the air inlet 402*f*, pushing piston 406 rearwardly against the force of the spring 407. This causes the needle 403 to move rearward as well. As a result, the blockade of the paint discharge port 402*a* by the front end of the needle 403 is raised, and paint is ejected through the discharge port 402*a*.

As the needle 403 is being pushed rearwardly, its rear portion simultaneously pushes the button 413 of the mechanical valve 410 rearwardly. By this action, the main shaft 412 moves rearwardly against the force of the spring 416. As a result, the packing 415 closes the main shaft hole 411*b*, while the rear portion of the main shaft 412 pushes the ball 417, raising the blockade of the air inlet 411*c*. Therefore, air supplied through the air supply pipe 419 is further supplied into the pressure switch 422 through the air connection port 411*f* and the air connection pipe 421. This causes an increase in the pressure of air within the pressure switch 422 whereby the switch 422 is actuated, causing a high-level signal to be transmitted via the signal line 424. In this way, the status of the spray gun 401 is detected on the basis of data displayed by the display, i.e., data indicating that the signal transmitted via the signal line 424 is at high-level.

If the needle 403 fails to return to the forward position where the paint discharge port 402*a* is closed, despite the fact that the supply of compressed air into the spray gun 401 has been stopped, this malfunction can be detected since the signal transmitted through the signal line 424 is still at high level.

Figure 19:
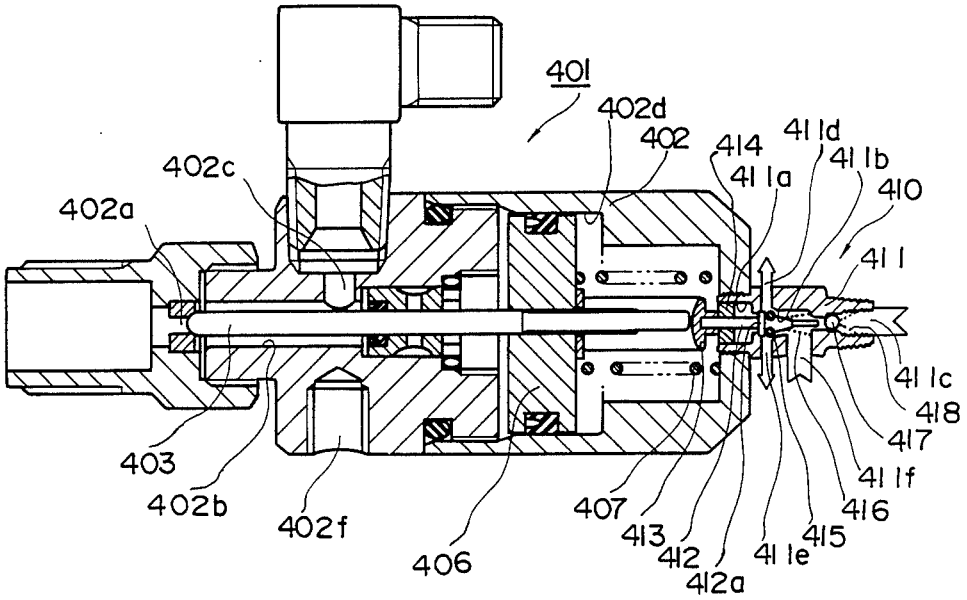
FIG. 19 is a view used to explain an arrangement which may be alternatively adopted in the spray gun.

Another embodiment of the spray gun 401 is depicted in FIG. 19. In this arrangement, the main body 402 of the gun and the mechanical valve 410 are formed as an integral structure, and the needle 402 abuts against the button 413 of the mechanical valve 410 at a portion within the main body 402.

The above-described device for detecting the condition of discharge of paint provides a higher level of reliability than a discharge condition detecting device in which a paint flowmeter is employed. Also, this spray gun is smaller than a conventional spray gun.

Figure 20:
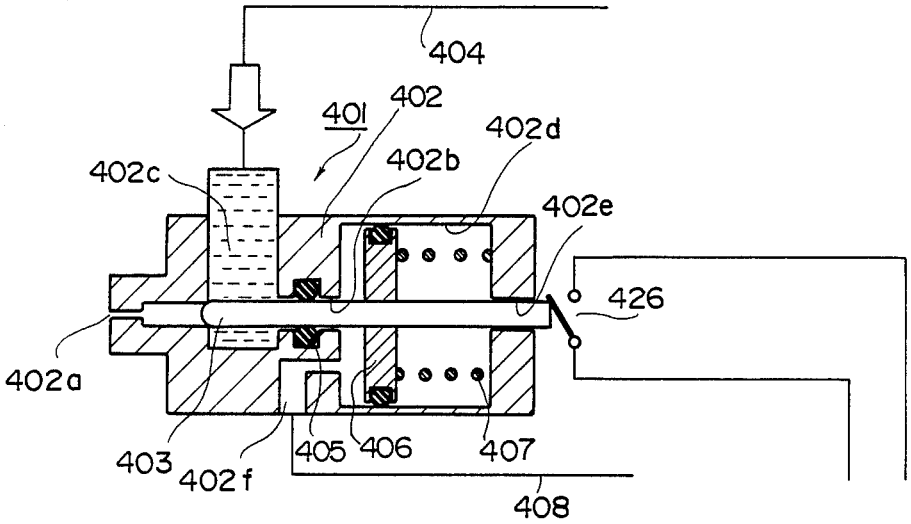
FIG. 20 is a sectional view showing another example of a spray gun.
Figure 21:
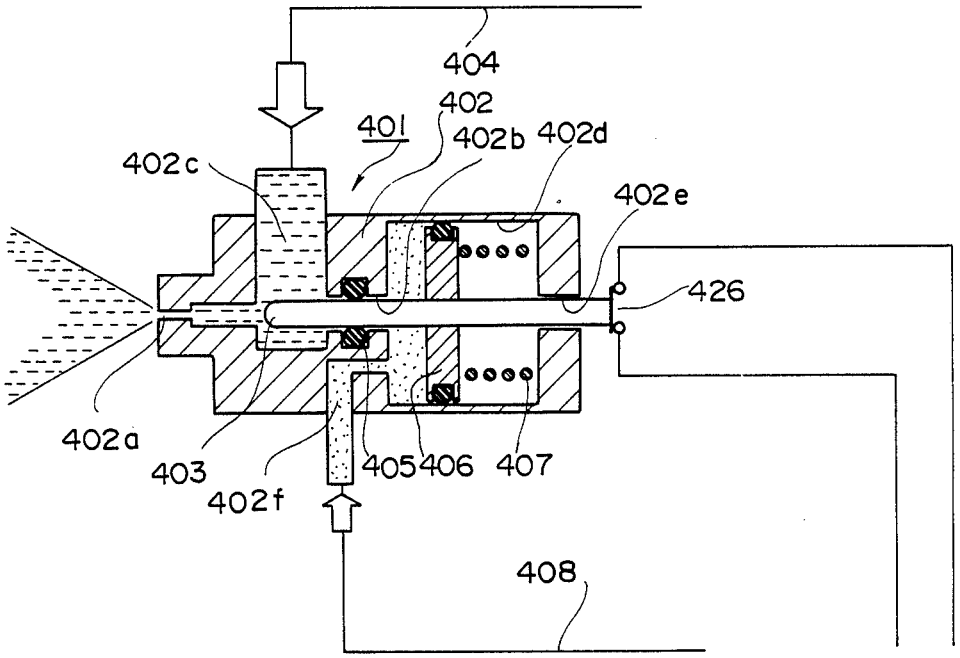
FIG. 21 is a view used to explain the operation of the spray gun shown in FIG. 20.

Yet another embodiment of a spray gun 401 is depicted in FIGS. 20 and 21. As shown in FIG. 20, the spray gun 401 has a main body 402 which is the same as that of the spray gun of the first example, and also has an arrangement in which an electrical switch 426 is used in place of the mechanical valve 410 and the pressure switch 422, the switch 426 being operable in response to the movement of the rear end of the needle 403. The remainder of the spray gun 401 is the same as in the preferred embodiment.

When the spray gun 401 is discharging paint, the needle 403 is retracted, with its rear portion pushing a movable element of the switch 426 and thus closing the switch 426, as shown in FIG. 21. On the other hand, when the spray gun 401 is discharging no paint, the needle 403 is advanced, thereby rendering the switch 426 open, as shown in FIG. 20.

A spray gun in which the above-described electrical switch 426 has a simpler structure than that of a spray gun employing a pressure switch, thereby facilitating production and maintenance.

The automatic painting system of the present invention provides the following advantages. With the automatic painting system of the present invention, the painting hood can be freely moved in various directions, in such a manner as to be brought into a position precisely facing the outer surface of the external wall of a building to be painted. When the opening of the hood is brought into press contact with the wall surface, the painting hood is maintained in air-tight contact with the wall surface even when the surface is irregular, preventing any scattering of paint mist. Furthermore, in contrast with the painting hood of a conventional automatic painting system, the painting hood of the present invention has no rollers, thereby making it possible to prevent any movement of rollers causing sever degradation in the quality of a portion of the wall surface which is already painted.

If the automatic painting system has a support including the above-described position determining devices, it is possible to prevent any random movement of the support due, to winds or vibrations, and to stop the support at a predetermined position with respect to the wall surface, thereby assuring positive operation of the painting system.

If the automatic painting system has the above-described vertical position detecting device, the position of the support can be detected easily with an increased degree of accuracy, thereby facilitating the checking of the position of the painting system and, hence, facilitating the operation thereof.

If the automatic painting system has the above-described guide groove painting devices, the guide grooves may be painted at the same time as the main wall surface portion, thereby ensuring that no part of the wall surface is left unpainted.

In addition, since the spray gun employed in the automatic painting system is the above-described automatic airless spray gun which is capable of detecting, by means of the mechanical valve linked to the needle, the condition of discharge of paint, it is possible to achieve a reduction in size of the spray gun from that of a conventional spray gun where a paint flowmeter is used. It is also possible to accurately detect the condition of discharge of paint by the spray gun.

While the painting system of the present invention has been described in conjunction with specific embodiments, many alternatives, modifications, and variations may be made to these embodiments in light of the disclosure herein. It is intended that the metes and bounds of the invention be determined by the appended claims rather than by the language of the above specification, and that all such alternatives, modifications, and variations which form a functional or cojointly cooperative equivalent are intended to be included within the spirit and scope of these claims.

We claim:

1. A system for automatically painting the external wall of a building, the external wall having two guide grooves formed along a vertical direction, the system comprising:

(a) a support suspended from a hoist apparatus, the hoist apparatus being disposed above the exterior wall, said support having a device for determining the horizontal position of said support, said horizontal position determining device having elements disposed within the guide grooves; and (b) a painting apparatus suspended by said support, said support including moving means which enable said painting apparatus to move in a horizontal direction, said painting apparatus including a painting hood having a spray gun disposed therein, said painting apparatus having means for advancing and retracting said painting hood in a direction normal to said external wall.

2. The system according to claim 1, further comprising a frame mounted on the peripheral edge of an opening of said painting hood, said frame opposing the outer surface of said external wall.

3. The system according to claim 1, further comprising means for rotating said painting hood in a lateral direction, enabling said painting hood to remain normal to the exterior wall when the exterior wall has an irregular surface.

4. The system according to claim 1, wherein each locating element is movable within the guide groove, a pair of rods extending in the longitudinal direction of said support, one end of each rod being fixed to one of said locating brackets, the other end of each rod being engaged with a locating actuator for moving said rods in the longitudinal direction of said support.

5. The system according to claim 1, further comprising a vertical position detecting device having a rotor which is in contact with the external wall, said vertical position detecting device being rotatable as said support is positioned vertically relative to the wall, said vertical positioning device having a signal generator for detecting the number of revolutions of said rotor, said signal generator generating a signal proportional to the vertical position of the rotor relative to the wall.

6. The system according to claim 1, further comprising a guide groove painting device which includes a casing having an opening into the external wall, a spray gun being mounted within said casing and directed toward the inner surface of the guide groove to effect spraying thereon, a plurality of partition plates being disposed within said guide groove, a partition plate having substantially the same planar configuration as that of the cross-section of the guide groove, said partition plates being repositionable within the guide groove, a first partition plate being disposed above the position of said spray gun within said casing, a second partition plate being disposed below the position of said spray gun within said casing.

7. The system according to claim 1, wherein said spray gun has a needle which is repositionable relative to a discharge port to open and close the discharge port for discharging pressurized paint therefrom, said spray gun being an automatic airless spray gun having means for detecting the position of the needle relative to the discharge port.

8. The system according to claim 7, wherein a front end of said needle faces said discharge port for discharging pressurized paint which is formed in the main body of said spray gun, the spray gun having means operable to cause the reciprocal movement of said needle for opening said discharge port and enabling the discharge of paint therethrough, a mechanical valve operable in response to the reciprocal movement of said needle to control the passage of compressed air, the spray gun having a pressure switch into which compressed air is introduced into said mechanical valve, said pressure switch generating an output signal indicative of the pressure of the compressed air.

9. The system according to claim 7, wherein the front end of said needle faces the discharge port for discharging pressurized paint which is formed in the main body of said spray gun, the spray gun having means operable to cause the reciprocal movement of said needle for opening said discharge port and enabling the discharge of paint, the spray gun having switch means operable in response to the reciprocal movement of said needle to generate an output signal indicative of the on-off position of said needle.

* * * * *